United States Patent [19]

Anderle

[11] 4,328,653

[45] May 11, 1982

[54] CEILING PANEL CLIP

[75] Inventor: Joseph A. Anderle, Clifton, N.J.

[73] Assignee: Levolor Lorentzen, Inc., Lyndhurst, N.J.

[21] Appl. No.: 114,588

[22] Filed: Jan. 23, 1980

[51] Int. Cl.[3] ..... E04B 5/55

[52] U.S. Cl. ..... 52/460; 52/489; 52/665; 52/715; 52/762; 52/781

[58] Field of Search ..... 52/483, 482, 489, 484, 52/144, 762, 715, 780, 781, 488

[56] References Cited

U.S. PATENT DOCUMENTS 3,277,622 10/1966 Jensen ..... 52/489

FOREIGN PATENT DOCUMENTS 1327617 4/1963 France ..... 52/489

*Primary Examiner*—John E. Murtagh

[57] ABSTRACT

A clip for attaching a filler strip to a channel for suspending ceiling panels, including prongs for holding the filler strip.

1 Claim, 4 Drawing Figures

CEILING PANEL CLIP

BACKGROUND OF THE INVENTION

The present invention relates to suspended ceilings and, more specifically, to a clip for attaching a filler strip or slat between parallel, spaced ceiling panels.

When installing ceiling panels and filler strips or slats from well known U-shaped channels that in turn are suspended from a ceiling in a building, shopping mall or the like, difficulties have been encountered in connecting the filler strips between adjacent ceiling panels. Where there is sufficient room at the end of the ceiling panels, the slats may be slid in sideways and held between adjacent ceiling panels by such ceiling panels. However, this is impossible in rooms where the suspended ceiling panels extend from one wall to the other wall. Even in large areas, such as shopping malls, at least one end of the panels is usually against a wall and the other end abuts additional panels or abuts against a beam. The slat or filler strip, although flexible, cannot be pinched sufficiently to snap in between ceiling panels. An alternative installation procedure has been to install a panel, then attempt to hold a filler strip along one edge of the installed panel while attempting to affix the second adjacent panel. This system is also impractical.

It is, therefore, an object of the present invention to provide means for attaching the filler strip or slat between panels of a suspended ceiling, which will overcome the above-mentioned disadvantages.

It is another object of the present invention to provide a clip which will hold the filler strip or slat to the U-shaped channel of a suspended ceiling.

It is still another object of the present invention to provide a clip which will in the initial stage of installation loosely hold the filler strip or slat in its intended position and also hold the filler strip or slat in the final position between assembled ceiling panels.

BRIEF DESCRIPTION OF THE DRAWINGS

The invention is illustrated, by way of example, in the accompanying drawings, in which.

DETAILED DESCRIPTION OF A PREFERRED EMBODIMENT

Figure 1:
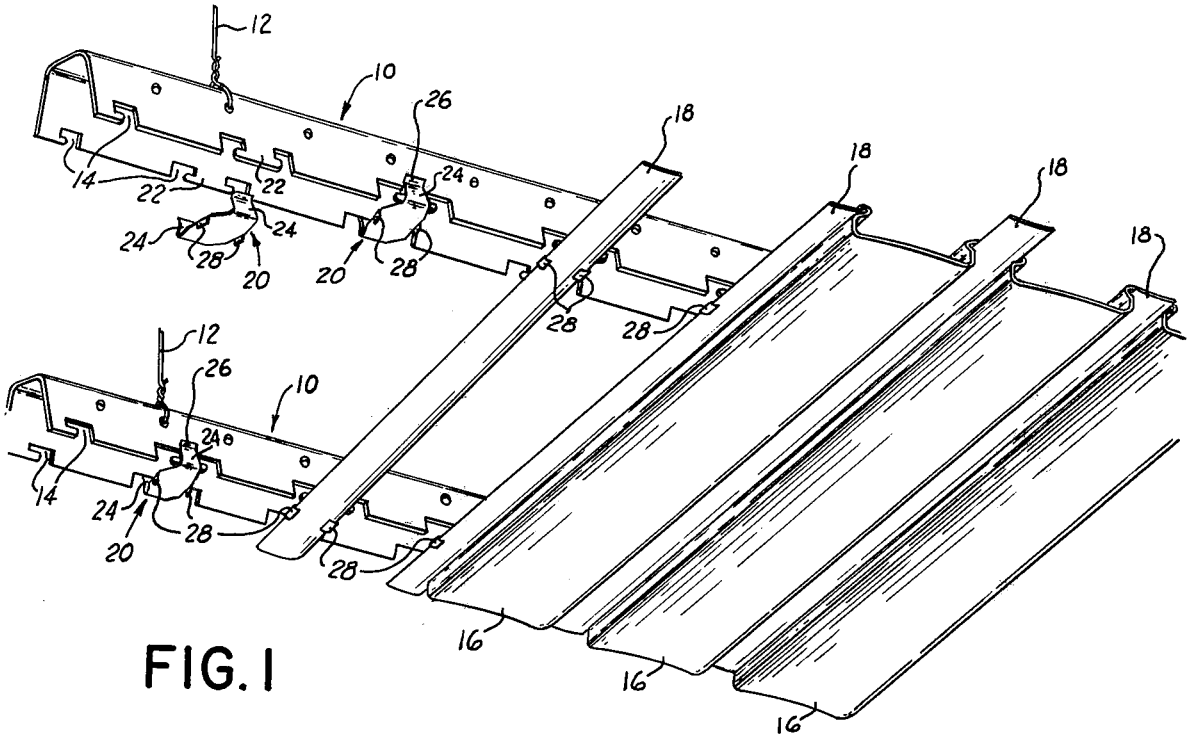
FIG. 1 is a perspective view of a suspended ceiling, as seen from the bottom.

FIG. 1 shows a part of a suspended ceiling, including two substantially U-shaped channels 10 suspended from a structural ceiling of a building or the like, by wires 12. Each U-shaped channel 10 has a number of slots 14 for receiving a number of parallelly arranged ceiling panels 16. The U-shaped channels 10 and the ceiling panels 16 are well known in the art.

With such suspended ceilings sometimes a gap is left between the individual ceiling panels 16. For some installations, especially inside a building, this gap is desirable for accoustical reasons. However, in other cases it is desirable to fill such gaps with filler strips or slats 18, for instance in walkways under overhangs, canopies or the like, to create a special design effect or to prevent the access of insects. If with such a suspended ceiling there is sufficient space between a wall and the ends of the panels 16 it is easily possible to slide the strips or slats 18 from the side into the space between adjacent panels 16. However, this has proved very cumbersome where there is only a very small gap left between the end of the ceiling panel 16 and an adjacent wall since the slats 18 would have to be bent with a very small radius. Sliding the slats in from the side is completely impossible where the slats actually engage a wall.

Figure 2:
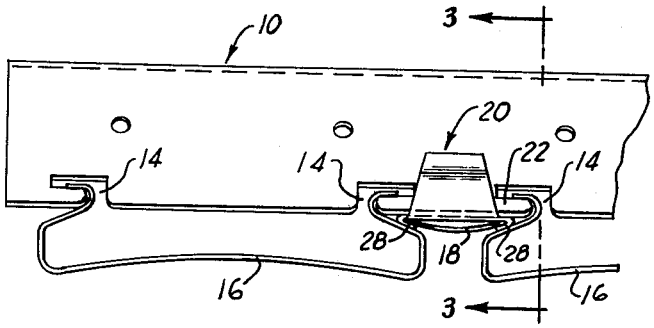
FIG. 2 is a side view of one of the supporting channels for suspending the ceiling, including a side view of the clip according to the present invention.
Figure 3:
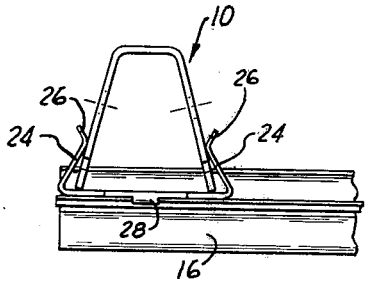
FIG. 3 is a section taken along the line 3—3 of FIG. 2.
Figure 4:
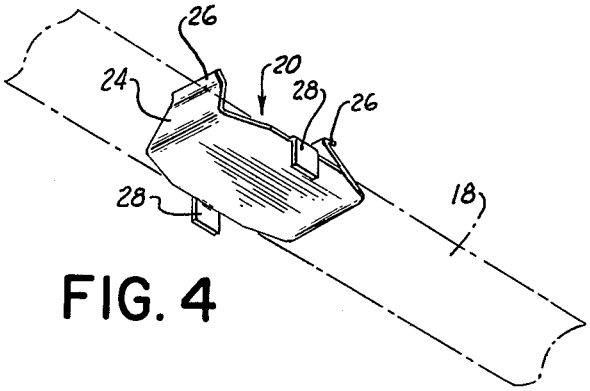
FIG. 4 is a perspective view of the clip according to the present invention.

According to the present invention this problem has been solved by providing special clips 20 which during assembly of the ceiling may be loosely suspended between adjacent panels 16 on the substantially T-shaped heads 22 of the U-shaped channels 10, as shown in FIG. 1. Each clip 20 has two spaced legs 24 which can easily be slipped over the lower end of the U-shaped channel 10. Each leg 24 has an outwardly bent end portion 26. Each clip is also provided with prongs or extensions 28 which make it possible to place a slat 18 from underneath against the clip 20 and then bend the prongs 28 inwardly around filler strip 18 to fixedly connect the same to the clip 20, and thereby to the U-shaped channel 10. The clips 20 are free to slide somewhat along the U-shaped channel so that upon attachment of an adjacent ceiling panel 16 it will assume an essentially central position. The prior assembled clips 20 and filler strips or slats 18 do not interfere with the installation of the ceiling panels 16 since they fit between the notches 14 of adjacent panels on the head 22. This is easily recognizable in FIG. 2.

It will be appreciated that the clip 20 will hold the filler strip or slat 18 in place, in effect creating a damping effect to prevent it from fluttering, vibrating or "singing" when subjected to wind in outdoor installation, such as under pedestrian walkways or in open shopping malls and the like. Insects, such as hornets and bees are prevented from entry into the space above the suspended ceiling. A fully enclosed ceiling without gaps with a geometric recess pattern between the panels is provided, and the fully enclosed ceiling may be monochromatic in which case the ceiling panels 16 and the filler strips 18 are of the same color, or the strip may have a different color in order to contrast with the panel.

I claim:

1. In a suspended ceiling: at least two substantially parallelly arranged U-shaped channels with legs flaring slightly downwardly with respect to each other and with spaced inverted L-shaped grooves facing each other so as to leave therebetween an essentially T-shaped portion, two ceiling panels received in said L-shaped grooves so as to be suspended from said channels, at least two clips, each clip comprising an essentially flat sheet metal body from which extend at substantially right angles two spaced leg portions engaging a respective one of said T-shaped portions of the respective channel, and from which body extend, at essentially right angles in a direction opposite to that of said leg portions and at an angle of 90° with respect to the latter, two spaced prongs, and at least one essentially flat strip of flexible sheet metal extending between said ceiling panels, said prongs being bent around said strip to thereby attach the same to said channel independently of said ceiling panels.

* * * * *